United States Patent [19]

Kajita et al.

[11] Patent Number: 4,509,321

[45] Date of Patent: Apr. 9, 1985

[54] APPARATUS FOR MANUFACTURING FASCIATED YARN

[75] Inventors: Koji Kajita, Omihachiman; Takashi Nakayama; Seiichi Yamagata, both of Otsu, all of Japan

[73] Assignee: Toray Industries, Inc., Tokyo, Japan

[21] Appl. No.: 491,414

[22] Filed: May 4, 1983

[30] Foreign Application Priority Data

May 4, 1982 [JP] Japan ..... 57-73340
May 4, 1982 [JP] Japan ..... 57-73336

[51] Int. Cl.[3] ..... D01H 5/28
[52] U.S. Cl. ..... 57/328; 57/333
[58] Field of Search ..... 57/204, 205, 328-331, 57/393, 394

[56] References Cited

U.S. PATENT DOCUMENTS

| | | | |
|---|---|---|---|
| 3,490,219 | 1/1970 | Ozawa et al. | 57/328 |
| 3,978,648 | 9/1976 | Yamagata et al. | 57/328 X |
| 3,992,865 | 11/1976 | Tuchida et al. | 57/328 |
| 4,112,658 | 9/1978 | Morihashi | 57/328 |
| 4,183,202 | 1/1980 | Morihashi | 57/328 |
| 4,434,611 | 3/1984 | Hasegawa et al. | 57/328 |

*Primary Examiner*—Donald Watkins
*Attorney, Agent, or Firm*—Austin R. Miller

[57] ABSTRACT

Apparatus for manufacturing fasciated spun yarn by false-twisting and detwisting a bundle of fibers is provided. The apparatus has a fiber-diffusing section which utilizes differential fluid flow to separate and transfer free fibers in a stable manner for subsequent wrapping about the fiber bundle as the bundle is detwisted.

24 Claims, 61 Drawing Figures

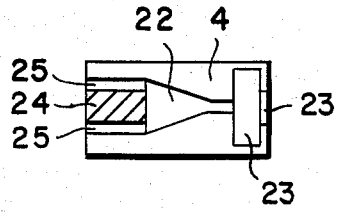
FIG. 2F(1)
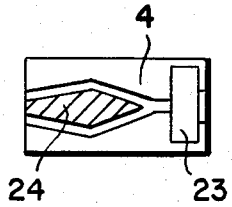
FIG. 2F(2)
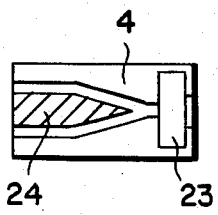
FIG. 2F(3)
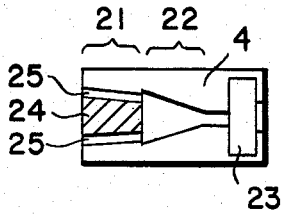
FIG. 2F(4)
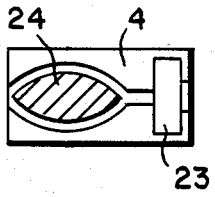
FIG. 2F(5)
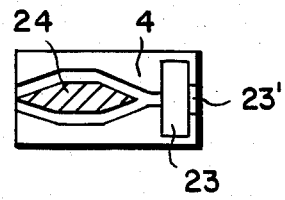
FIG. 2F(6)
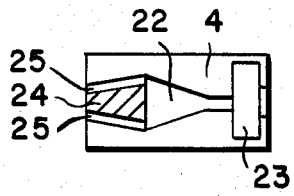
FIG. 2F(7)
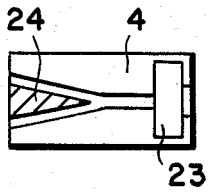
FIG. 2F(8)
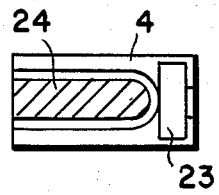
FIG. 2F(9)
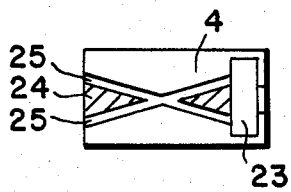
FIG. 2F(10)
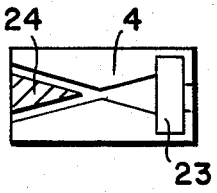
FIG. 2F(11)

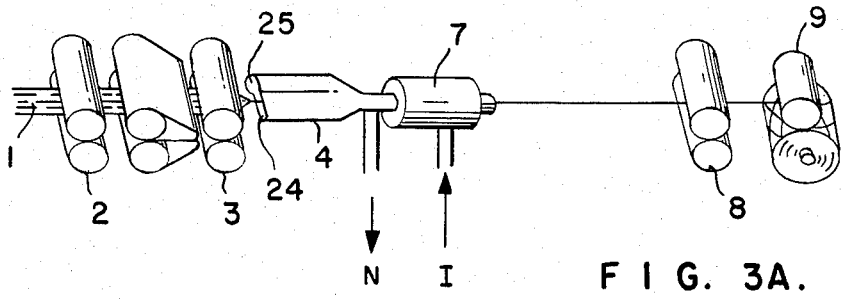
FIG. 3A.
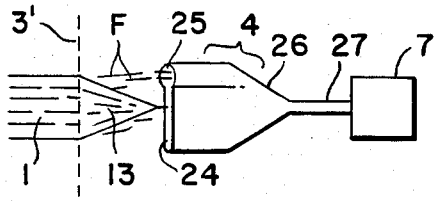
FIG. 3B.
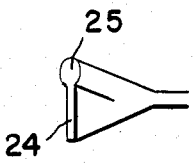
FIG.3C(1)
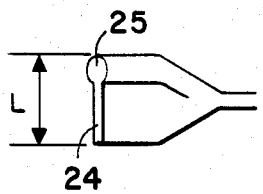
FIG.3C(2)
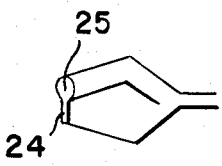
FIG.3C(3)
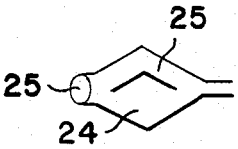
FIG.3C(4)
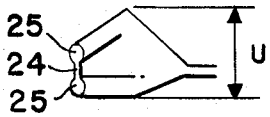
FIG.3C(5)
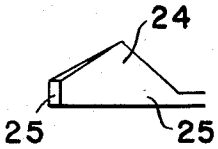
FIG.3C(6)
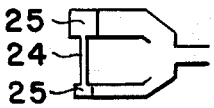
FIG.3C(7)
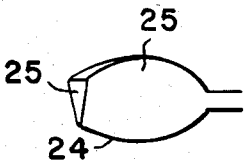
FIG.3C(8)

APPARATUS FOR MANUFACTURING FASCIATED YARN

BACKGROUND OF THE INVENTION

This invention relates to an apparatus and for manufacturing fasciated spun yarn.

The fasciated spinning method, which is energy-saving, which manufactures yarn at a high rate and which has wide material range capability, has attracted much attention in recent years as a new spinning method superceding the well-known open-end spinning method. This fasciated spinning method is used to manufacture fasciated spun yarn consisting of a substantially untwisted fiber bundle with binder fibers wound around the fiber bundle. It involves the steps of false-twisting a roller-drafted ribbon-shaped fiber bundle to generate free fibers whose free ends are not incorporated into the twisted fiber bundle, combining the free fibers with the twisted fiber bundle unitarily so that the free fibers are not twisted or are twisted to a different degree, and thereafter detwisting the fiber bundle.

When a ribbon-shaped bundle of drafted fibers is twisted in accordance with the above technique, the greater part of the fibers becomes a bundle of twisted fibers. However, fibers at the edges of the fleece are not twisted; their front or back ends are likely to be free. It is considered that, since the end-free fibers are transferred separately from the twisted fiber bundle, fibers with one or both ends free are produced. Accordingly, transferring end-free fibers separately from a twisted fiber bundle plays an important role in the operation of the apparatus.

DESCRIPTION OF THE PRIOR ART

An apparatus of this kind, using an aspirator, is disclosed in U.S. Pat. No. 3,079,746. In this apparatus the air current in the yarn passage is unduly turbulent and its flow rate fluctuates greatly. Therefore, such apparatus is not suitable for transferring fibers in a stable manner.

Another fiber transfer means which includes a pneumatic suction pipe is disclosed in U.S. Pat. No. 4,003,194. The yarn is passed linearly owing to a suction air current flowing therein. This suction pipe is advantageous in that the air current is not very turbulent, and the fibers can be stably transferred. However, the use of only a cylindrical pipe produces insufficient numbers of free fibers. This makes it difficult to spin a strong yarn.

U.S. Pat. No. 4,112,658 discloses the use of two false-twist nozzles arranged in series. These nozzles are air-pressurized and are adapted to twist the fibers in opposite directions and thereby form surface-wound fibers. However, since two nozzles are used, the pressurized air cost increases. Further, it is difficult to balance the forward and backward twisting pressures and the binding fibers can be wound excessively tightly around the fiber bundle to produce a hard fasciated spun yarn.

A conventional fasciated yarn spinning method will be described in detail, taking as an example the disclosure of U.S. Pat. No. 4,003,194. The disclosed method consists of drafting a bundle of staple fibers, feeding the drafted fibers in their opened state onto an apron which is capable of transmitting a false twist to the fibers on the downstream side thereof to an upstream nip point, false-twisting mainly the short fibers in the central portion of the drafted fibers on the apron to generate a false-twisted fiber bundle with completely untwisted short fibers on both sides thereof having one or both ends free, or short peripheral fibers in a similar condition, and thereafter untwisting the false-twisted bundle while winding the short peripheral fibers around the untwisted fiber bundle in the direction opposite to the false-twisting direction.

In the spun yarn obtained by the foregoing method, the main fiber bundle constituting the greater part of the spun yarn is substantially untwisted and the main fiber bundle is bound around its circumference by short peripheral fibers (free fibers). Accordingly, the strength of the spun yarn and the binding ratio of the spun yarn mainly depend upon the quantity of the free fibers and the skill with which they are wound.

In such a conventional method a special apron and the necessary support structure are used to generate and transfer the free fibers. This causes an increase in the number of components of the apparatus. Using this method, it is difficult to control the short staple fibers which tend to fly during the spinning operation, and is accordingly difficult to obtain a uniformly spun yarn. In addition, the life of the apron is short.

The aforementioned disadvantages in the apparatus and quality of the yarn obtained also occur in the use of other known techniques.

SUMMARY OF THE INVENTION

An object of the present invention is to provide an apparatus for stably manufacturing high strength spun yarn which is free from the drawbacks heretofore encountered. In this connection another object is to utilize a suction current having a fiber-diffusing effect to generate a selected quantity of free fibers positively and to transfer the free fibers in a stable manner.

Still another object of the present invention is significantly to improve the high-speed stability and quality of the yarn and to provide a yarn which has a longer life. Still a further object is to provide an apparatus of simplified construction minimizing equipment cost and greatly reducing maintenance expense.

BRIEF DESCRIPTION OF THE DRAWINGS

FIGS. 3A-3C (1-8) illustrate various embodiments of an apparatus according to the present invention having a fiber diffusing section providing different fluid flow velocities at different places;

FIG. 4A is a perspective view and FIG. 4B is a longitudinal sectional view taken as indicated by the lines and arrows Y—Y which appear in FIG. 4A;

DESCRIPTION OF THE PREFERRED EMBODIMENTS

The present invention provides an apparatus for manufacturing fasciated-spun yarn by false-twisting a fleece of short fiber bundle which have been draft-cut or drafted, such apparatus having between its short-fiber drafting section and its false-twist section a fiber-diffusing section having a special shape. The apparatus, as will become apparent hereinafter, utilizes a flowing fluid to arrange and transfer the free fibers efficiently and in a stable manner.

According to the present invention, an air current having a highly advantageous fiber-diffusing effect is utilized for arranging and transferring the free fibers, as will become apparent hereinafter.

The present invention will now be described with reference to the accompanying drawings. Although specific terms will be used in the interest of clarity they are not intended to define or to limit the scope of the invention, which is defined in the appended claims.

Figure 1A:
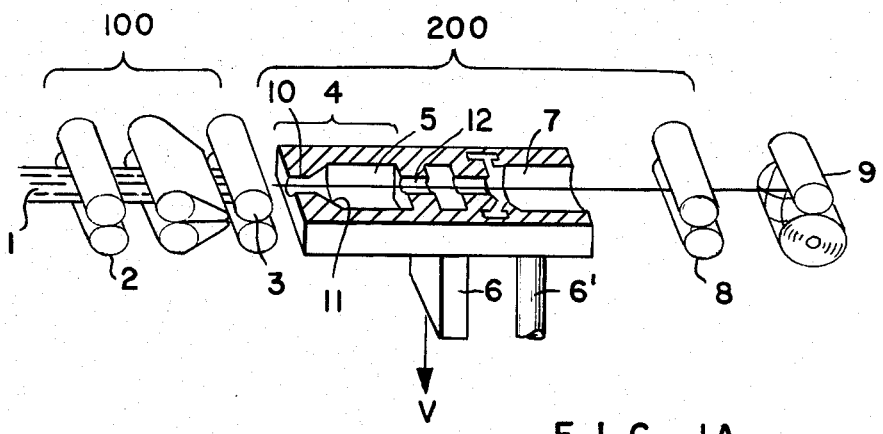
FIG. 1A illustrates in perspective, with certain portions broken away and shown in section in order to reveal important details, an apparatus according to the present invention having a fiber diffusing section using a suction fluid.

FIG. 1A shows an example of a fasciated-spinning apparatus according to the present invention. The number 100 generically represents a drafting zone and the number 200 generically represents a yarn-forming zone with a fiber diffusing section.

Tow or sliver 1 is draft-cut and/or drafted between back rollers 2 and front rollers 3, i.e. in the drafting zone 100, so that it is formed into a band or ribbon-shaped fiber bundle which is then introduced into a vaccum chamber 5 in a fiber-diffusing section 4. The pressure in the vacuum chamber 5 is lower than that at the inlet port 10.

The vacuum chamber 5 communicates with a vacuum source V, which may, for example, be an air nozzle in a false-twist section, namely a yarn path 12 may be connected to a vacuum source through a pneumatic suction pipe 6, or any other suitable vacuum source. In operation, a plurality of fibers are caused to undergo a separation process in the fiber-diffusing section 4, such separation involving either the complete free fiber (both ends free) or at least one end of the fiber free from the outer surface of the false-twisted fiber bundle. It is preferable that these free ends of fibers are produced while controlling the flow rate of the fluid which is a suction fluid, which is preferably suction air. For the purpose of this invention the fluid should be kept flowing in a substantially laminar flow, and should not flow turbulently or whirl as in an aspirator jet. In this way substantial numbers of fibers are maintained as free fibers with one or both ends in the free state.

To meet such requirements, the pressure in the vacuum chamber is preferably below atmospheric pressure and in the range of 200–1500 mmAq.

The distance between the final nip point in the drafting section (or other feed means for feeding to the fiber-diffusing section 4) and the false-twisting section is preferably not more than twice the average length of the staple fibers constituting the short-fiber bundle. Within this range, the free fibers can be controlled easily, and the yarn-piecing operation can be carried out easily when starting up.

The fiber bundle and free fibers there around are bound to each other by ballooning of said bundle or by an air current. Thereafter it is false-twisted by false-twist nozzle 7 into a unitary fiber bundle. When the unitary bundle passes the twist point of the nozzle 7, a detwisting force is applied so that the free fibers are wound around the outer surface of the detwisted bundle. As a result a fasciated spun yarn is formed. The fasciated-spun yarn is then nipped and drawn by delivery rollers 8, to be taken up on a winder 9.

Figure 1B:
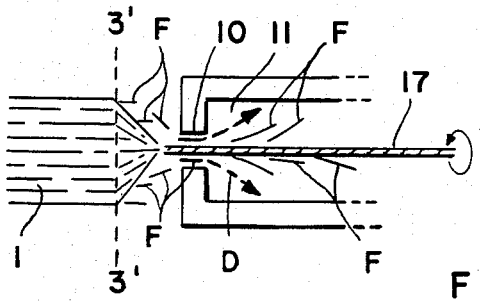
FIG. 1B is a schematic fragmentary top plan view in longitudinal section showing a portion of a fiber diffusing section according to this invention.

FIG. 1B illustrates schematically a typical flow of air and the manner in which floating fibers F are generated. As is clear from the drawing, the incoming portion of the suction air current which is at or close to the inlet port 10, downstream of the feed nip line 3'—3', flows at a high rate through and past the inlet port 10 in the yarn direction but flows at a reduced rate in the fluid diffusion portion 11 in vacuum chamber 5. Thus the air current suddenly spreads laterally, as indicated by the dash lines and arrows D. When the bundle of drafted and twisted fibers passes through the inlet port 10 it is in a loosely twisted condition, therefor the fiber ends in the bundle are not firmly held in it and the free ends of the separated fibers are not yet combined unitarily with the twisted fiber bundle. Accordingly the separated fibers are not taken up with the twisted fiber bundle and can be stably carried by diffused air flow in such a condition that the separated fibers F are extended straight and separated from said twisted bundle. After passing the twist point, the separated fibers F are combined unitarily with the twisted fiber bundle 17 by the ballooning of the latter, or by a binding air current.

After the fiber bundle has passed through the false-twist nozzle 7 (FIG. 1A) the fiber bundle is detwisted and the free fibers are wrapped in a manner to serve as binder fibers which are helically wound around the detwisted fiber bundle. Thus a fasciated-spun yarn having sufficient yarn strength is formed.

The apparatus according to the present invention is ideally adapted for the processing of fibers of various kinds and properties, including longer draft-cut fibers having an average length of at least 120 mm and shorter draft-cut fibers having an average length of less than 40 mm. Short staple fibers, especially short staple fibers containing cotton, cotton-polyester, cotton-nylon, cotton-acrylic or cotton rayon mixtures are preferably used. The mixtures may have any ratio because cotton has an extremely wide fiber length distribution range and because cotton fibers lend themselves easily to being separated, so that free fibers can be produced easily when a flowing fluid is applied thereto. 100% polyester fibers can also be spun according to this invention.

It is an important feature of the present invention that the fiber-diffusing section 4, using a suction fluid, is provided between the drafting section and the false-twist section.

A preferred example of the fiber-diffusing section 4 as shown in FIGS. 1A and 1B has a restriction 10 that is an inlet portion downstream of the drafting zone 100 or feed nip line 3'—3' and a fluid-diffusing portion 11 upstream of the false-twist section 7.

When a fluid suction means 6 is provided adjacent the false-twist nozzle 7, the flow rate of the suction air increases at inlet portion 10 and decreases in diffusion portion 11. The fluid diffusing portion 11 may also serve as a mechanism for retaining already-separated fibers in a free condition and so transferring such fibers. In said fiber diffusing section the suction air may be diffused vertically, laterally, diagonally, or at any angle or combination of angles. Namely complex differential flow rates of suction air are formed in said fiber diffusing section, or several different main suction flows having different air flow rates or air flow volumes are created in said section or special air flow having distribution of flow rate or volume is created.

The distance between the nip point of the downstream rollers 3 in the drafting section 100 and the inlet port 10 is preferably in the range of about 5–20 mm. Within this range the yarn-forming operation can be carried out easily. When the distance is less than about 5 mm, the fibers tend to catch on the nip point of the rollers 3. When the distance is more than about 20 mm, the fibers do not spin well at start-up. However, this distance may exceed 20 mm if the diffusion section, or a diffusion section combined unitarily with a false-twist nozzle, is designed to be movable.

In the apparatus according to the present invention, the fiber-diffusing section 4 and the false-twist nozzle 7 can be positioned in a single housing for compactness and ease of operation. This also substantially prevents undesirable generation of fiber dust.

The construction of the fluid-diffusing section will be described below in more detail. The cross-sectional area of the diffusing portion 11 in the axial direction of the yarn is preferably about 1.1–100 times as great as that of the restriction that is the inlet portion 10. The inlet portion 10 may have a rectangular, round or elliptical shape, as shown respectively in (1), (2) and (3) of FIG. 1C. The inlet portion 10 may have any other shape including square, triangular, polygonal having more than five sides or multi-angular shapes. The inlet port 10 may include a frictional member.

Figure 1D:
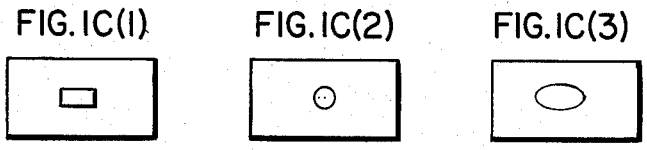
FIGS. 1C (1-3) and 1D represent modifications of portions of the apparatus illustrated in FIG. 1B.
Figure 1D:
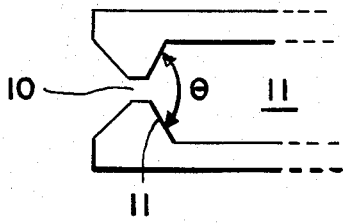

As shown in FIG. 1D, the wall 11' of the diffusing portion 11 may expand from the inlet port 10 at any angle, i.e. from an acute to an obtuse angle. The included angle is preferably within the range of 30°–180°. The entrance of the inlet port 10 may be tapered or arcuately formed.

The false-twist section of the apparatus according to the present invention may consist of various components or systems having false-twisting functions; for example known parts or systems such as fluid nozzles, spindles, disk-friction type false-twisting units or belt types of false twisting units may be used. Of these, a fluid nozzle, especially an air nozzle is preferably used; an air nozzle has a good yarn-feeding capability and permits the suction and transfer of even the upstream portion of the yarn. In said air nozzle, compressed air is provided through pipe in 6' FIG. 1A.

In the apparatus according to the present invention, a suction pipe 6 (FIG. 1A) may be provided between the fiber-diffusing section and the false-twist section. The suction pipe 6 is connected to a vacuum source and serves to remove fiber dust. It further permits the suction of yarn, when the spinning operation is started, and serves to introduce yarn into the false-twist nozzle 7 to assist in starting the spinning operation. A combining section 12 (FIG. 1A) is preferably provided between the fiber-diffusing section 4 and the false-twist nozzle 7. When the combining section 12 is provided the free fibers are brought into contact with the yarn 17 efficiently and effectively.

In addition, two or more false-twist nozzles may be used in the apparatus according to the present invention. Also, an apron may be used behind the nip point of the rollers 3 or the nip line 3'—3'. A bundle of short fibers may contain filaments or comparatively long staple fibers.

Figure 2A:
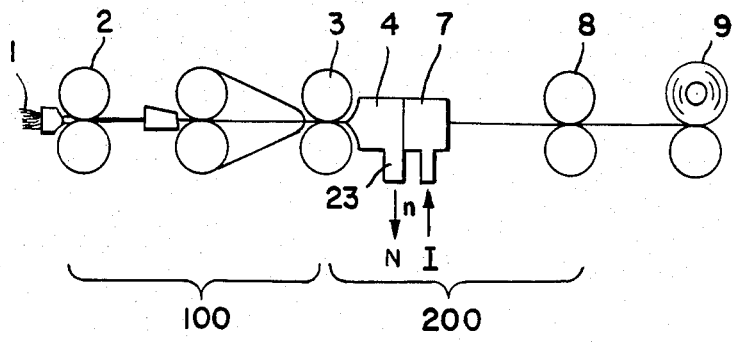
FIG. 2A illustrates another form of apparatus according to the present invention.

Another embodiment of the present invention, as shown in FIGS. 2A–2F, will now be described. FIG. 2A shows an embodiment like FIG. 1A, but means N are provided for establishing and maintaining a discharge air current n, and means I are provided whereby compressed air is introduced into the false-twist air nozzle. The fiber-diffusing means shown in FIG. 2A is also different from that shown in FIG. 1A, as will further appear.

Figure 2B:
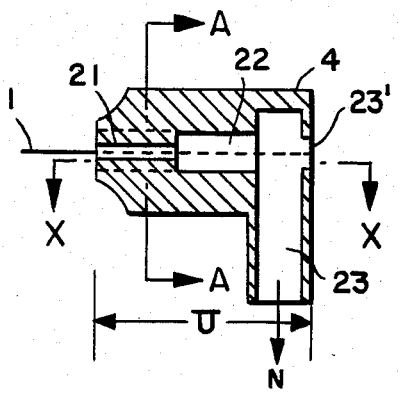
FIG. 2B is an enlarged sectional view of a fiber diffusing section of FIG. 2A, having a narrow passageway with enlarged edge portions.

The fiber-diffusing section 4 of a yarn-forming zone 200 of FIG. 2A has the cross-sectional shape shown in FIG. 2B, and consists of a transfer portion 21, a bundling portion 22 and a discharge portion 23. Cross sectional configuration of said portion 21 is for instance basically a slit like shape extending in the width direction of the fleece and having at least one enlarged slit portion provided at at least one end of said slit like shape. Examples of the cross sectional configuration of portion 21 are shown in FIG. 2C.

The inner restricted passageway portion 24 (FIG. 2C) (that is a basic slit) is narrowed (having a width W) and enlarged edge passageways 25, 25 are provided on at least one end thereof, and having a width W' communicating with slit 24. Owing to this construction and as is apparent from an inspection of all of (1), (2), (3), (4), and (5) of FIG. 2C, the air flows mainly in the enlarged edge passageways, 25 to forcibly suck both edges of the fleece outwardly to generate free fibers. Thus, free fibers which are not twisted into the main fiber bundle are conveyed downstream in a stable manner around the main fiber bundle. The yarn thus formed passes out of the false-twist nozzle 7 to detwist in the usual manner. However, the free fibers in contact with the main fiber bundle are wound around the main fiber bundle as it detwists, as will now be apparent.

In the foregoing embodiment, it is necessary that the enlarged slit portion 25 have a width W' greater than the corresponding width W of basic slit 24, to produce stronger air currents at one or both edges of the slit as compared to the air current in the slit portion 24. It is preferable that each of the enlarged slit portions 25 has a width W' not less than 1.5 times the width W of the slit 24. The passageways of the enlarged portion 25 may have circular, triangular or rectangular shapes, as shown in FIG. 2C, or others. The slit may also have various shapes, as will be apparent. In this embodiment, the shape of the slit at the inlet of a fiber bundle may be varied to form a deviation having different suction air flow velocities along the slit. The central slit 24 preferably has a narrow width which permits the main fiber bundle to be twisted and allows it to pass through easily.

Figure 2E:
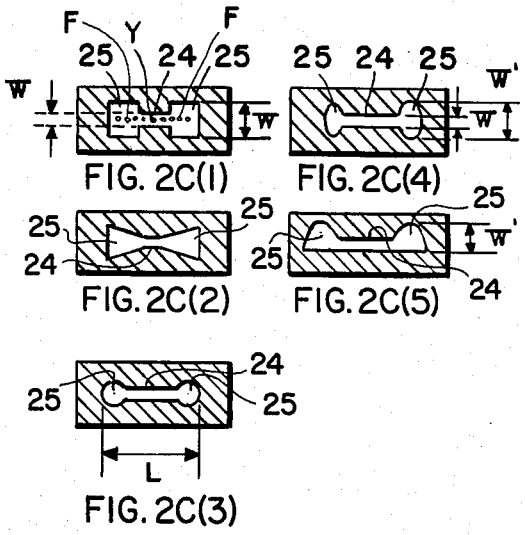
FIG. 2C (1-5) is a group of sectional views, each showing an alternative embodiment, taken as indicated by the lines and arrows A—A which appear in FIG. 2B.
FIGS. 2D (1-3), 2E and 2F (1-11) are cross-sectional views taken as indicated by the lines and arrows X—X which appear in FIG. 2B showing various embodiments illustrating different types of slits and bores.
Figure 2E:
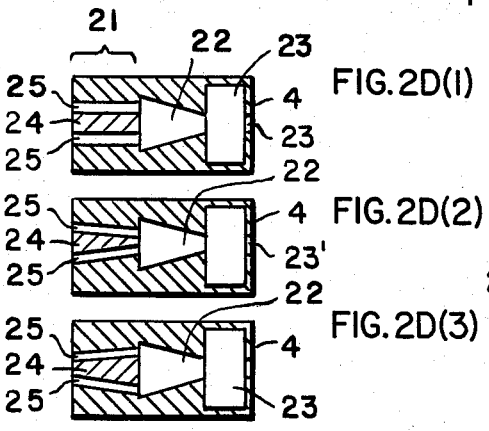
Figure 2E:
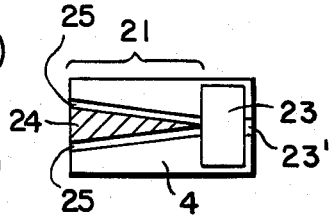

Various longitudinal arrangements of the slits 24 and enlarged slit portion 25 appear in FIGS. 2D, 2E and 2F. The slit of the transfer portion 21 may extend straight (FIG. 2D (1)), convergently (FIG. 2D (2)) or divergently (FIG. 2D (3)) in the lengthwise direction. The diameter of the outlet 23' which is joined to the discharge portion 23 of the bundling portion 22 affects the fiber binding operation.

As soon as such diameter has no significant influence upon the fiber suction and transfer operations, it preferably is small and a suitable diameter of this outlet 23' is 2–5 mm. Even when the transfer portion 21 is extended by modifying or omitting the bundling portion 22, as long as the transfer portion 21 is connected directly to the discharge portion 23 as shown in FIG. 2E and some versions of FIG. 2F, an excellent effect can be obtained. When the total length of the fiber-diffusing section 4 including the transfer portion 21, bundling portion 22 and discharge portion 23 is not greater than the mean length of the fibers in the sliver supplied and false-twisting air nozzle, and is directly contacted to the outlet 23', the free fibers can be wound around the fiber bundle very easily, and yarn piecing operating can be done very easily and the operating efficiency of the apparatus is improved.

The basic slit portion having a narrow width W is shown in FIGS. 2 D, E, F as being immediately adjacent to and having the same shape as the cross-hatched portion wherein the cross-hatching lines are inclined from left to right.

FIGS. 3A–3B show still another embodiment, which is formed by providing an enlarged passage portion at one edge of the slit 24 in the fiber-diffusion section of the apparatus. Referring to FIG. 3A, the same numbers are used to show corresponding parts in previously described embodiments. The fiber diffusing section 4 of this embodiment has a laterally-extending narrowed suction portion that is a slit 24 which has an enlarged slit portion 25 at or near an edge thereof. The suction air current flows into and through the enlarged slit 25 at a higher volumetric rate than through the narrowed portion 24. Expressed in other terms, the suction air current flows in a lateral or width wise direction of the fleece in an asymmetrical manner. The fleece or fiber band 1 introduced into this fiber-diffusing section 4 is subjected to a laterally unbalanced air current and pressure, so that many more end-free fibers are produced in the enlarged slit portion than in the slit having narrowed width. In this embodiment, as will further become apparent, currents having different flow rates or flow velocities are also preferably formed in the direction which is at right angles to the fiber bundle, to carry out the diffusion of the fibers efficiently.

The above operation will be further described with reference to FIG. 3B. The drafted ribbon-shaped fleece 1 is discharged from the nip point 3' of the front rollers 3 with the fibers kept essentially parallel to adjacent fibers in a substantially non-entangled condition, to be twisted by a false-twist nozzle 7 to form a fiber bundle. The edge fibers F, because of the diffusing effect of the air currents, resist being captured by the fiber bundle and many of them accordingly become end-free-fibers. Accordingly, the flow rate of the air current in the enlarged slit portion 25 is high, and consequently the ends of many of the fibers F in the edge portion of the fleece are freed, or both ends are freed, by the diffusing effect of the air current. These freed peripheral fibers are transferred through the fiber-diffusing section 4 in a stable condition and separately from the twisted fiber bundle. This enables a substantial amount of free fibers to be formed.

The free fibers thus produced are combined unitarily with the twisted fiber bundle by ballooning or applying an air current thereto, or by a suitable binding member. After the resulting fiber bundle has then passed beyond the twist point of the nozzle 7, the bundle is detwisted and the free fibers are wound around the outer surface thereof to form the fasciated-spun yarn product. This fasciated-spun yarn is then nipped and drawn by delivery rollers 8, to be taken up by a winder 9.

In the present invention, it is important that the laterally asymmetrical fluid flow be in the form of a stratified current which is substantially free from turbulence. Fluid flow in a stratified condition causes free fibers to be produced and to be transferred in a stable manner. The stratified air current may be generated by utilizing the suction force of a false-twist nozzle which is combined unitarily with the fiber-diffusing section, or the suction force of an additional suction nozzle, or otherwise.

In this embodiment, it is preferable that the fluid be applied to the fleece in such a manner that the fluid flows downstream with respect to the movement of the fleece, from the drafting zone toward the false-twist section. The fluid may be applied to the fleece at a maximum of 90° to the flow direction of the fleece. If the angle is more than 90°, advancement of the fleece is obstructed and this causes neps in the yarn and a reduction in yarn strength.

In the foregoing embodiment, the faster fluid flow is generated at only one end portion of the diffusing section; this makes it possible to spin a strong yarn in the case of generating it at bath both end portions of the section. When the drafted fleece is twisted, surprisingly the free end fibers appear at both sides of the fiber bundle. Generally the free end fibers are not distributed equally along both sides of the fiber bundle and sometimes they appear much more on one side than another.

The reasons for this phenomenon are not all known, but it is believed that certain relationships have a bearing on the surprising results obtained. Both of the edge portions of the fleece are not twisted equally due to the relationship between the direction in which the fiber bundle is twisted, the direction in which the fleece is fed to the nip point of the front rollers, and the direction in which the yarn is drawn to be taken up. Therefore, it is preferable that a relatively fast air current be applied to the edge of the fiber bundle on which a larger proportion of free fibers can be produced.

In some cases, free fibers are produced in equal amounts on both sides of the fleece.

Further, the setting angle of said fiber diffusing section to said fiber fleece is not limited in particular. Nor is the relationship between the position at which said diffusing section is set and the passage of yarn. In other words, the yarn passage may be disposed either at or away from the central portion of the slit or in a position close to one side thereof, for example.

According to the present invention, the separating ability of a drafted fleece has an influence upon the generation of free fibers. When the fleece is easily opened up, free fibers are generated in a stable manner. In order to improve the separating ability of the fleece, it is effective to draft it at a higher stretch ratio. Widening the fleece may be employed as a supplementary means for this purpose.

The results of many runs show that a preferred fleece draft ratio is at least 80. A fleece draft ratio of 100–250 is more preferably used in practice.

An important point regarding this embodiment of the invention resides in the shape of the inlet portion of the fiber-diffusing section. The shapes of the portions of the embodiment which are behind the inlet portion are also important. The inlet portion of the fiber-diffusing section can be any one of the shapes shown in FIG. 2C and 3C, taking those shown in FIG. 2D, 2E and 2F into consideration.

The inlet portion of the fiber-diffusing sections shown in FIGS. 3C (1)—3C (3) have a basic slit portion 24 being laterally elongated with an enlarged slit portion 25 provided at one side of each of the slit portions 24 thereof. The examples of fiber-diffusing sections are convergent in the lengthwise direction thereof as shown in FIG. 3C (1), straight as shown in FIG. 3C (2), and divergent and then convergent as shown in FIG. 3C (3). The fiber-diffusing sections shown in FIGS. 3C (4)—3C (6) have a cross-sectionally symmetrical inlet portion, but the shapes of the portion just behind the inlet portion of each diffusing section are varied in such a manner that the length of the slit L, or shape or area of it and the angle of inclination of the enlarged slit portion is different in each respective portion along the width of the slit. Owing to these shapes of the fiber-diffusing sections, asymmetrical air currents can be formed immediately behind the inlet portion.

As shown in FIGS. 3C (7) and 3C (8), the inlet portion can be formed asymmetrically by taking a slit shape other than a circular shape, such as a rectangular or triangular shape, or a shape (not shown) such as a polygonal or multi-angular shape having an enlarged slit portion or edge like shape. Also an enlarged slit portion may be formed in the portion of the diffusing section which corresponds to the yarn passage.

The diffusing section may have any shape other than those of the examples shown in the drawings, provided that the diffusing section is capable of forming therein passages having different fluid flow velocities or fluid flow rates.

The fiber-diffusing section is preferably provided at its outlet region with a bundling portion 27 utilizing a convergent portion 26 thereof, to join together the free fibers and the twisted fiber bundle in an excellent manner. The diameter of the bundling portion 27 is preferably relatively small, which does not have any significant influence upon the fiber-suction and transfer operation; a suitable diameter of the bundling portion 27 is about 2–5 mm.

Figure 4A:
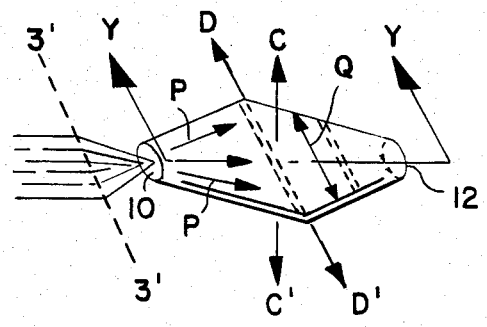
FIGS. 4A–4B illustrate an alternative embodiment of a fiber diffusing section of different form according to the present invention.
Figure 4B:
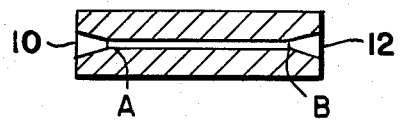

FIGS. 4A and 4B show a further example of a fiber-diffusing section used in the present invention, wherein FIG. 4A is a perspective view and FIG. 4B is a sectional side elevation. This fiber-diffusing section has elliptical inlet port 10 and outlet port 12, with a slit between portions A, B in FIG. 4B, which slit has a constant size in the widthwise direction and longitudial direction of the fleece. Namely, the slit mentiond has equal width in both length wise and yarn transfering direction. The portions of the fiber-diffusing section which are between the inlet port and the slit, and between the slit and the outlet port are tapered, i.e. the width of the space constituting the yarn passage is decreased or increased. The reasons why a slit thus formed permits the free fibers and a twisted fiber bundle to be separated at a higher efficiency are not clearly known. However, it is considered that the degree of freedom of the suction current in the direction of the width of the slit (C—C' in FIG. 4A) is restricted thereby, so that the suction air current in the fiber-diffusing section flows constantly. As a result, the degree of freedom of the suction current in the direction of the length wise of the slit (D—D') is also restricted. Therefore, it is considered that the twisted fiber bundle and the free ends of fibers occurring at both sides of the fleece, which are separated when the ends of the fibers are freed, are transferred as they are kept separated, since the degree of freedom of the suction current in the length-wise direction direction of the length wise slit is restricted.

In the fiber-diffusing section in this example, the length of the slit Q gradually increases from the inlet port to the central portion of the diffusing section, so that the air current becomes a diffused current shown by the arrows P in FIG. 4A. Accordingly, this diffusing section is capable of further displacing the free ends of the fibers, from the twisted fiber bundle. This allows the separation of the free ends of the fibers from the twisted fiber bundle to be carried out very well.

Figure 5:
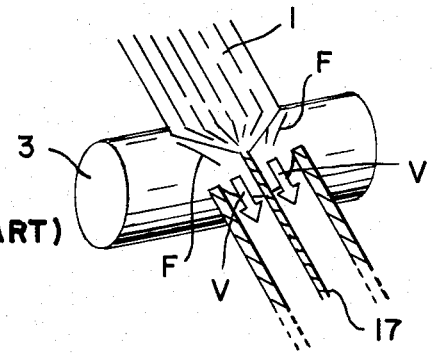
FIG. 5. (PRIOR ART)
FIG. 5 illustrates a straight suction pipe used in a conventional fasciated yarn apparatus.

FIG. 5 illustrates a conventional apparatus of this kind. The air current at the inlet portion flows straight or convergently as shown by the arrows V—V in FIG. 5, and the air current continues to flow to the compressed air ejection nozzle or the like. The distance between the inlet portion and the ejection nozzle or the vacuum-communicating port is very great; it is at least 10 mm at its shortest.

When an air current is applied parallel to the direction of advance of the yarn, or a convergent air current is applied to the fleece at a position in the vicinity of the fleece twisting point, the free fibers F, which have started to be separated from both sides of the fleece, are not fully separated from the twisted fiber bundle 17. Owing to the ballooning effect of the twisting operation, the free fibers F are combined unitarily with the twisted fiber bundle before the free fibers have been sufficiently transferred. Accordingly, using the arrangement of FIG. 5, it is difficult to obtain a yarn having a sufficiently high strength or evenness of strength along the yarn axis.

Figure 6:
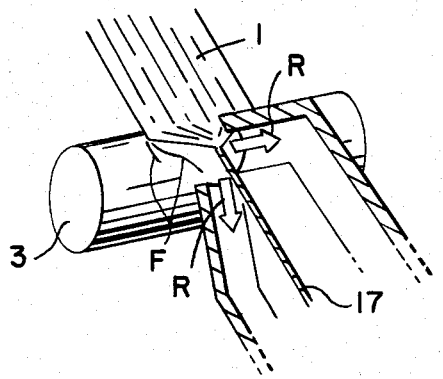
FIG. 6 illustrates in a perspective embodiment of the principles of the present invention.

In another embodiment of the present invention shown in FIG. 6, suction air currents (arrows R), which flow at angles to the lateral axis of the fleece with respect to the axis of the yarn, are generated in the vicinity of the inlet port of the fiber-diffusing section 4. The fleece twisting point determines the occurrence of free fibers, mainly at the inlet of the transfer means. Therefore, the twisted fiber bundle 17 advances straight without being substantially influenced by air currents, and the free fibers F occurring on both sides of the fleece advance in accordance with the movement of the air current so that they are separated in the upward or downward direction with respect to the widthwise direction of the fleece. The separated free fibers are transferred for a significant distance while they are kept separated from the twisted fiber bundle, so that they become free fibers. In this example, the free ends of the fibers are thus separated positively in the vertical direction and transferred. Free ends of the fibers can be produced at a higher rate than in many of the other examples.

A fiber-diffusing section generating such an air current referred to above will now be described.

Figure 8:
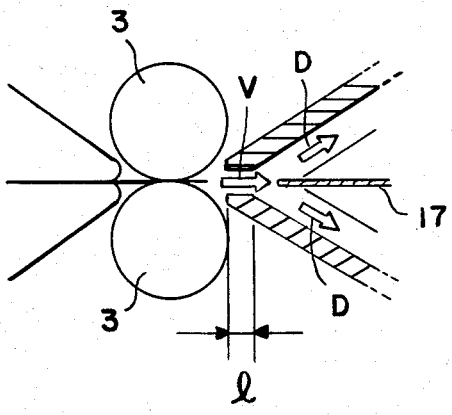
Figure 9:
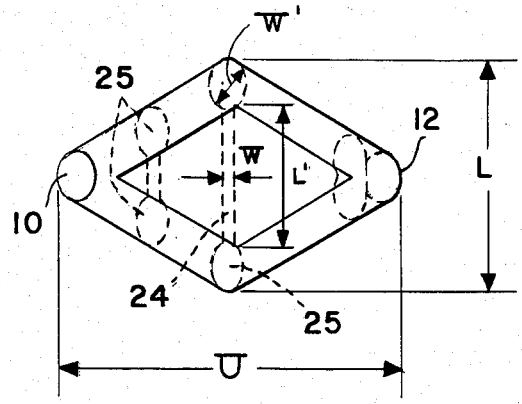
Figure 9:
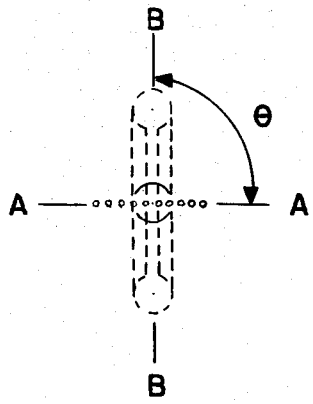
Figure 9:
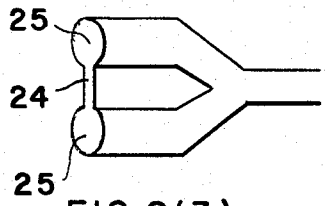
Figure 9:
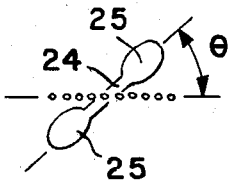
Figure 9:
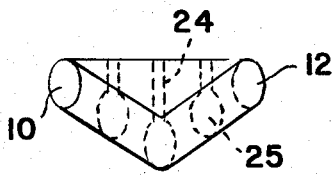
Figure 9:
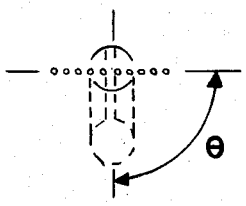
Figure 9:
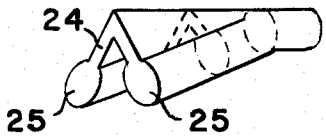
Figure 9:
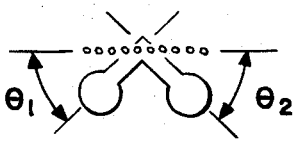

In FIGS. 9(1) and 9(2) certain dash lines have been provided to show in perspective the cross-sections of a certain slit. FIGS. 9(1) and 9(2) show a fiber-diffusing section having inlet and outlet portions 10, 12 respectively consisting of cross-sectionally circular area, a slit portion 24 at an intermediate region thereof, (several are shown in dotted lines for ease of understanding) with enlarged slit portions 25 at both ends of the slit portion 24. When the outlet portion 12 of this fiber-diffusing section is connected to a vacuum source, a suction air current is drawn into the slit from the inlet 10 and divided to flow through the left and right enlarged slit portions 25, 25, so that the air in the slit portion flows at a lower rate than in the enlarged slit portion 25. FIG. 9(2) shows the relationship between the lateral axis A—A of the fleece and the axis B—B of length wise direction of the slit, which are viewed in the axial direction of the yarn (from the upstream side to the downstream side). The slit of said diffusing section shown in FIG. 9(1) is set at an angle between axis A—A and B—B of $\theta=90°$ in FIG. 9(2). When the diffusing section is set in this manner, the current in the inlet portion of the fiber-diffusing section is divided into two vertically separated currents to cause the free ends of fibers at both edges of the fleece to be separated upwardly or downwardly with respect to the lateral axis of the fleece. Namely, as shown in FIG. 8, the fleece discharged from nip rollers 3, 3 is subjected to a suction air current V at the inlet of the fiber-diffusing section and then immediately subjected to the separating action of the diffused currents shown by arrows D, D, so that part of the fibers are separated from the main fiber bundle 17. These free ends of fibers later become binding fibers. It is preferable that the distance l at which the suction current shown by arrow V in the inlet port of the fiber-diffusing section shown in FIG. 8 works on the fleece is not more than 5 mm.

FIGS. 9(3) and 9(4) show another example of a fiber-diffusing section having an inlet, a cross section of a slit portion 24 and enlarged slit portion 25 with parallel air currents flowing therein. When this fiber-diffusing section is set at, for example $\theta=45°$, a suction current is generated which is inclined at an angle to the widthwise direction of the fleece to separate the free ends of fibers at both sides of the fleece in the upward and downward directions. In this case, the left-hand portion of the fleece in the drawing is separated downwardly, and the right-hand portion upwardly. The direction in which the free ends of fibers are separated is preferably opposite to the direction in which the fleece is false-twisted.

FIG. 9(5) shows an example of a fiber-diffusing section having inlet and outlet portions 10, 12 respectively consisting of cross-sectionally circular holes, a slit portion 24 at an intermediate region thereof, and an enlarged slit portion 25 at one side of the slit portion 24. When this fiber-diffusing section is set as shown in FIG. 9(6) ($\theta=90°$) the suction current in the inlet portion flows downwardly to separate the free ends of fibers at both sides of the fleece in the downward direction.

Figure 7:
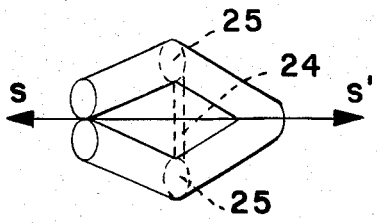
FIGS. 7 (1–4), 8 and 9 (1–8) illustrate other embodiments of the fiber diffusing section of the present invention.
Figure 7:
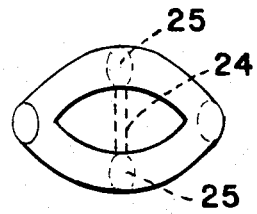
Figure 7:
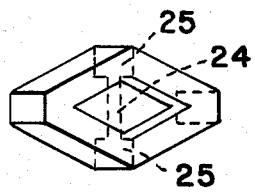
Figure 7:
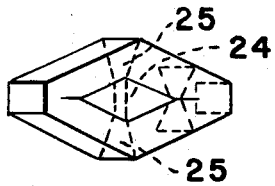

FIGS. 7(1)–7(4) show other examples of fiber-diffusing sections which may be used in the practice of the present invention. As shown in the drawings, the enlarged slit portion may have any cross-sectional shape, other than a circular shape, such as a rectangular or other shape. The enlarged slit portion may be formed arcuately in the longitudinary direction S—S′ thereof. The fiber-diffusing section of the present invention is not limited to these examples. A fiber-diffusing section having a wide variety of other shapes can also be used, provided that it permits the generation of a suction current flowing at an angle to the lateral axis of the fleece with respect to the axis of the yarn.

Figure 10:
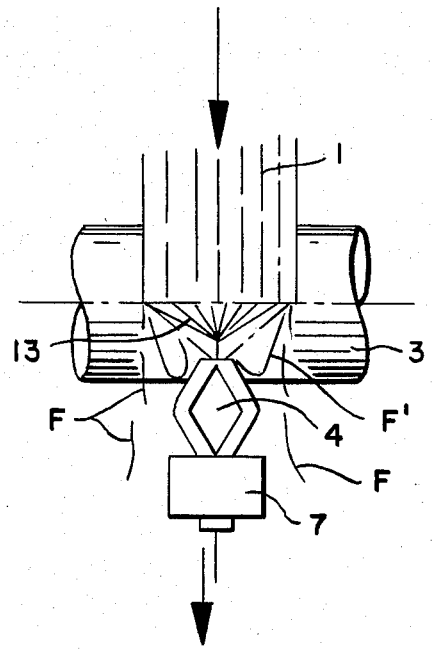
FIG. 10 illustrates a comparative example.

A comparative example will now be described. FIG. 10 shows a typical construction using a fiber-diffusing section 4, the inlet of which has an outer diameter of 3–5 mm. The drawing shows the behavior of the fibers being processed. The fleece 1 fed from nip rollers 3 is sucked and transferred by the fiber-diffusing section 4 and twisted by the pneumatic false-twist nozzle 7.

When the spinning rate becomes at least 100 m/min, the free ends of fibers F and F′ are bent or scattered as shown in the drawing, and it becomes difficult to obtain free ends of fibers in the desired manner. Moreover, the yarn obtained has many neps and very uneven strength.

Figure 11:
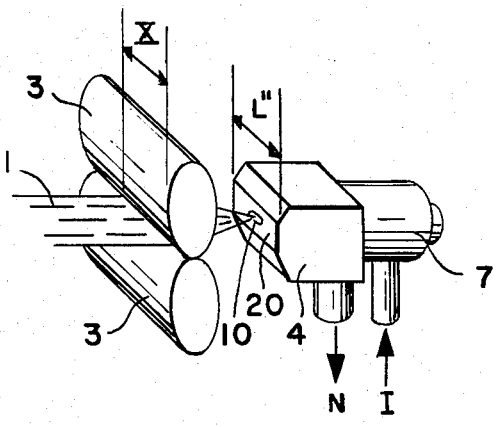
FIG. 11 illustrates the inlet of the fiber diffusing section of the present invention.

Still another embodiment of the present invention is capable of eliminating the foregoing disadvantages. As shown in FIG. 11, a surface 20 facing the roller 3 is provided having an inlet 10 of a fiber-diffusing section 4, which has a flat configuration. The length L″ of the surface 20 is predetermined in such a manner that $L'' \geqq \frac{1}{3}Z$, wherein Z is the width of the fleece fed from the nip rollers 3. The fiber-diffusing section 4 may have any of the shapes and constructions already described.

When the distance between the nip point of the nip rollers 3, 3 and the inlet 10 is less than 12 mm, the clearance between the fiber-diffusing section 4 and the nip rollers serves as a passageway for a pneumatic suction current. This increases the pressure of the air current flowing from both sides of the clearance toward the central suction bore. Accordingly, even when the spinning speed is high, the free ends of fibers flying out from the nip rollers due to their inertial force float inwardly on this air current and are transferred without being tangled into the fiber-diffusing section, so that free fibers are produced to obtain a uniformly fasciated-spun yarn.

When the width of the inlet surface 20 of the fiber diffusing section is $L'' < 3Z$, the quantity of scattered or bent fibers 14 increases in the manner shown in FIG. 10, and a spun yarn having many neps and an increased degree of strength unevenness is obtained. The width of the surface 20 is preferably $L'' \geqq \frac{1}{2}Z$.

The inlet surface 20 is preferably flat, but it may consist of a curved surface having a large radius of curvature. The surface 20 may be parallel to the nip rollers of tapered slightly toward the central inlet portion or curved with a large radius of curvature, in its length wise direction. It is important that the surface 20 be substantially flat.

According to the present invention, the area of the surface 20 is preferably at least 30 $mm^2$, and more preferably at least 60 $mm^2$, to improve the described inertial effect. The width of the surface 20 is preferably at least 7 mm, and more preferably at least 10 mm, to suck the peripheral fibers in the flattened short-fiber fleece into the fiber-diffusing section in an excellent manner.

Figure 12:
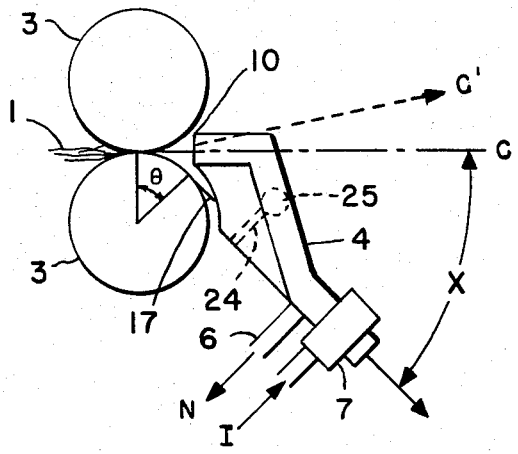
FIGS. 12, 13, 14 and 15 illustrate further embodiments of the invention.

A further embodiment of the present invention is shown in FIG. 12. The fleece 1 is discharged from nip rollers 3 in the direction C which is the common tangent to both nip rollers 3. Since a false-twist nozzle 7 is disposed along a line at an angle X with respect to the tangent of the nip roll, the fibers turned toward the nozzle 7 from the rolls 3 are bent. A fiber-diffusing section 4 is provided between the nip rollers 3 and the false-twist nozzle 7. The interior of the fiber-diffusing section 4 consists of a slit portion 24 and an enlarged slit portion 25, and communicates near its outlet with a suction pipe 6. Since the rate of flow of air in the fiber-diffusing section 4 is influenced by its cross-sectional area the rate of flow of air in the enlarged slit portion 25 is higher than the rate of flow of air in the slit portion 24. Accordingly, the majority of the air entering inlet port 10 flows through the enlarged slit portion 25, i.e. in the direction C.

When the fiber-diffusing section 4 is so arranged that the direction in which the fleece advances toward the enlarged slit portion 25 coincides with the direction in which the fleece is fed from the nip rollers, the direction in which the inertially discharged fibers advance and the direction in which the suction air flows coincide with each other, so that the fibers are naturally drawn in that direction. In this embodiment, a fiber bundle twisted by the false-twist nozzle is taken up at an angle X, so that the fiber bundle advances separately from the suction current. At the same time, the free ends of fibers present in the peripheral portions of the fleece advance straight along the line C, to be sucked by the suction air current and, are thereby completely separated from the twisted fiber bundle. The separated free ends of fibers are then transferred through the enlarged slit portion 25 as free fibers. These free fibers are combined unitarily with the twisted fiber bundle by the ballooning of the twisted fiber bundle, or by the action of the air current. After the free fibers have passed through the false-twist nozzle 7, they become binder fibers which are wound around the core fiber bundle as the latter is detwisted.

According to the present invention, the free ends of fibers are separated and transferred positively, so that a substantial amount of free fibers can be provided in a stable manner for eventual service as binder fibers in the yarn product.

When the suction current in the embodiment of FIG. 12 is applied in a direction at an angle to the direction in which the yarn is taken up, for example in the direction C′ as shown in FIG. 12 which is on the other side of the yarn-advancing direction with respect to the direction in which the fleece is discharged, the free ends of fibers can be separated more effectively. This accordingly constitutes a preferred embodiment of the present invention. The angle between the yarn and the position at which the suction current is applied to the fibers, (i.e. the inlet port 10 of the enlarged passageways) is preferably about 10°–90°. The inlet port 10 may be positioned at an angle to the yarn within that range in the horizontal, vertical or diagonal direction.

Figure 13:
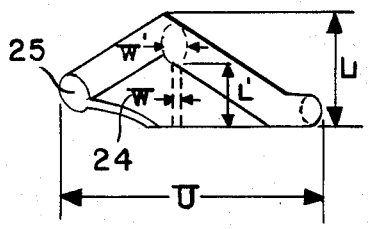

FIG. 13 shows an example of another form of fiber-diffusing section 4 of this embodiment. In this fiber-diffusing section, the width W shown in FIG. 13 in the slit portion is preferably around 5–0.2 mm, and the diameter or width W′ of the enlarged slit portion, which in this case is a slit having a circular cross section, is preferably about 1.0–1.5 mm. These values are determined by the yarn number. For example, when the yarn number is 20′S–80′S, the fiber-diffusing section is formed in such a manner that W=about 2–0.2 mm and W′=4–1.5 mm. In order that the greater part of the suction current flows into the enlarged slit portion, it is necessary that the diameter W′ be greater than the width W. The ratio of the diameter W′ to be width W is preferably $W'/W>2$. When the enlarged slit portion has a cross-sectional shape other than a circular shape, for example a rectangular shape, the diameter of a circle having the same area as the rectangle may be compared with the distance W′. The maximum value of the width L′ of the slit portion is preferably at least 3 mm. When this maximum value is less than 3 mm, the separation and transfer of free fibers and the twisted fiber bundle cannot be carried out well.

Figure 15:
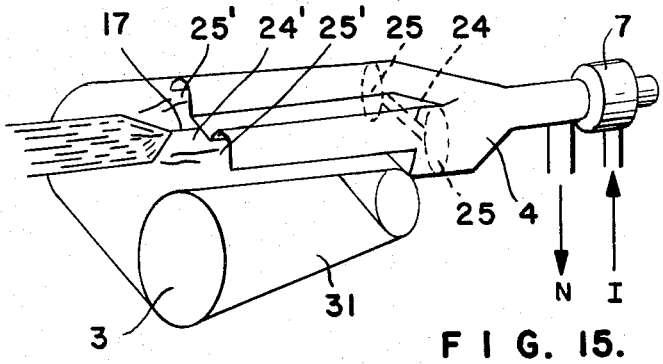

A further embodiment of the present invention is shown in FIG. 15. In this embodiment, a narrow space 24′ and enlarged passageways 25′ are formed in a space between a conveyor belt 31 wrapped around a bottom nip roller 3 and the fiber-diffusing section 4. In this embodiment, the twisted fiber bundle 17 also passes through the narrow (slit) space 24′, and the free ends of fibers occurring on both peripheral portions of the fleece fed from the nip roller 3 advance in the enlarged passageways 25′ which have groove-like shapes. Both the narrow space 24′ and the enlarged passageways 25′ have the same function as mentioned about slit 24 and enlarged slit portion 25 respectively. This occurs because of the air current and the rotation of the conveyor belt 31. Consequently, the free ends of the fibers are separated from the twisted fiber bundle and are further transferred. Accordingly, free fibers can be produced in a stable manner, and a spun yarn having good strength can be manufactured.

Figure 14:
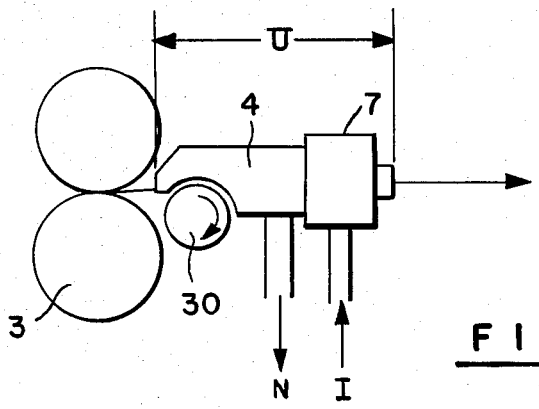

A further embodiment is shown in FIG. 14. In this embodiment, an additional rotatable roller 30 is provided immediately downstream of the nip rollers 3 to form a slit space and a groove between the roller 30 and the fiber-diffusing section 4. In this case, the groove and slit space may be formed in the suction pipe or on the surface of the roller by a grooving process. The operational effect of this embodiment is essentially the same as those of the previously described embodiments of FIGS. 12 and 13.

According to the present invention, the flat surface and interior of a fiber diffusing section and the inner surface of a pneumatic false-twist-nozzle may be formed of a material having high wear-resistance, for example, special ceramic materials known for this property.

The unique effects of the apparatus according to the present invention will be described below.

(1) Since free fibers can be produced very efficiently even by one false-twist nozzle, the yarn can be spun at a high speed. This allows the consumption of compressed air to be reduced.

(2) All or substantially all of the yarn-forming section consists of stationary parts. Accordingly, the yarn-forming section is maintained easily, and the yarn-forming operation can be stabilized.

(3) The surface-winding fibers of the spun yarn obtained are not tightly attached thereto; they are combined flexibly with the yarn. Therefore, the yarn is as smooth and soft as a ring-spun yarn. Also the strength of the yarn obtained by this apparatus is as high as that of a ring-spun yarn. Thus, the apparatus according to the present invention permits the forming of yarn having a wide range of applications.

(4) Even when the spinning speed is increased, free ends of fibers can be wound on the twisted yarn reliably without causing the former to come off the latter, so that a high-speed spinning operation can be carried out in a stable manner. Moreover the production of fiber dust and chips is low.

(5) The free ends of the fibers, which are formed continuously, can be wound without being in a folded condition around the twisted yarn. Accordingly, a high-quality yarn having substantially no neps, high strength and uniform properties can be obtained.

EXAMPLE 1

A mixed silver consisting of 65% 1.3 d×38 mm polyester staple and 35% American cotton passed through a comber was supplied to the fasciated-spinning apparatus shown in FIG. 1, to manufacture a fasciated-spun yarn at a draft ratio of 150, a suction vacuum of 400 mmAq, air pressure at the false-twist nozzle of 3.2 kg/cm$^2$ and a spinning speed of 150 m/min.

The fiber-diffusing section 4 of the apparatus used was provided with an inlet 10 having a 3 mm (width)×9 mm (height) rectangular cross section, and a vacuum chamber 5 having a 10 mm (height)×20 mm (width) rectangular cross section. The properties of the yarn thus obtained and those of a yarn spun by using a conventional cylindrical (13 mm inner diameter) pneumatic suction pipe are shown in Table 1. The yarn obtained by the apparatus according to the present invention was clearly superior to that obtained by the conventional pneumatic suction pipe.

TABLE 1

| | Apparatus according to the present invention | Comparative example |
|---|---|---|
| Pneumatic suction means | Provided with a node portion and a diffusion portion | Simple cylindrical body |
| Yarn number | 35S | 35S |
| Strength (g) | 254.5 | 151 |
| Strength CV (%) | 10.5 | 33.8 |

EXAMPLE 2

A mixed staple yarn of 45'S consisting of 65% polyester and 35% cotton was spun by using a fasciated-spinning apparatus in which the fiber-diffusion section 4 shown in FIGS. 2B and 2C (3) and a pneumatic false-twist nozzle 7 were provided immediately behind a roller-drafting section as shown in FIG. 2A.

Dimensions of the fiber-diffusing section:

Slit portion: 0.6 mm (width W), 10 mm (length L)

enlarged slit portions: 2.0 mm (width W'), cross-sectionally circular

Total length U: 20 mm

Spinning conditions:

Spinning speed: 140 m/min

Air pressure at the false-twisting nozzle: 2.5 kg/cm$^2$

Suction vacuum (connected by a branch pipe): 700 mmAq

The spinning operation was carried out excellently under the above conditions. High-quality yarn having a strength of not less than 200 g was obtained.

EXAMPLE 3

The same fiber diffusing section as in Example 2 was connected to a pneumatic pipe, which has a branch pipe, and disposed immediately behind a front roller of a ring spinning frame having a 3-line type of drafting section, in such a manner that the lateral axis of a slit was at 90° to that of the fleece. Staple roving and filaments were supplied to this apparatus to manufacture a multi complexed spun yarn.

Staple: Polyester—65%, cotton—35%

Filaments: 50d-12f

Total yarn number: 34'S

Number of twists: 850T/M

Suction vacuum: 400 mmAq

In said spun yarn spun under the above conditions, the filaments were covered by the staple excellently when compared with those in a multi complexed yarn spun without using a fiber-diffusing section. Namely, a high-quality multi complexed yarn was obtained in this Example.

EXAMPLE 4

Fasciated-spun yarn was manufactured by using the fasciated-spinning apparatus shown in FIG. 3A having the fiber-diffusing section shown in FIG. 3C(3).

A mixed sliver consisting of 65% polyester (1.3d×38 mm) and 35% combed American cotton was supplied to the fasciated-spinning apparatus to manufacture a fasciated-spun yarn at a total draft ratio of 203, an overfeed ratio between the delivery rollers of 3%, air pressure at the false-twist nozzle of 3.0 kg/cm$^2$, vacuum at the pneumatic suction pipe of 400 mmAq, and a speed of front rollers of 150 m/min. The properties of the yarn thus obtained and those of a comparative fasciated-spun yarn manufactured by using a cylindrical suction pipe are shown in Table 2. It is clear that the strength of the yarn can be improved to a great extent by using a fiber diffusing section in the present invention.

TABLE 2

| | Example | Comparative Example Conventional techniques) |
|---|---|---|
| Suction means | Laterally-extending slit with one circular enlarged slit portion at one side thereof | Simple cylindrical body |
| Yarn number | 46.1 | 46.0 |
| Strength (g) | 217 | 20 |
| Strength CV (%) | 11.1 | 10.3 |

EXAMPLE 5

A mixed yarn of 45'S consisting of 65% polyester and 35% cotton was spun by using a fasciated-spinning apparatus, the construction of which is as shown in FIG. 1A, provided with the fiber-diffusing section shown in FIGS. 4A and 4B. Dimensions of the fiber-diffusing section:

Total length U: 16 mm

Inlet and outlet ports: Cross-sectionally elliptic, having a width of 3 mm and a height of 2.5 mm.

Width of slit W: 0.6 mm

Maximum length of slit: 10 mm

Spinning conditions:

Total draft ratio: 180

Suction vacuum: 700 mmAq

Air pressure at false-twist nozzle: 3.0 kg/cm$^2$

Spinning speed: 150 m/min.

The yarn spun under the above conditions had excellent properties; the yarn had a strength of 199 g and an Uster yarn irregularity of 13.1%. The yarn can be obtained at a high speed.

EXAMPLE 6

A silver consisting of 65% polyester and 35% cotton was roller-drafted and spun by the apparatus shown in FIG. 11, in which the length L'' of the inlet surface 20 of the fiber-diffusing section 4 is varied. Scattered and folded fibers were seen at the inlet of a fiber diffusing section, and neps on the spun yarn were observed. The fiber diffusing section used had an inlet port in its flat surface.

Spinning conditions:
Spinning speed: 145 m/min
Draft ratio: 280
Width of fleece Z: 24 mm
Pneumatic vacuum: 700 mmAq
Spinning yarn number: 33'S

TABLE 3

| L'' (mm) | L''/Z | Scattered and bent fibers | Nep |
|---|---|---|---|
| 20 | 0.83 | 0 | 0 |
| 15 | 0.63 | 0 | 0 |
| 10 | 0.42 | 0 | 0 |
| 8 | 0.33 | 0~Δ | 0~Δ |
| 5 | 0.21 | x | x |

0: Excellent, x: Poor

The results are as shown in Table 3. The scattered and folded fibers started to occur when L'' was less than $\frac{1}{3}$Z, and the frequency of occurrence of such fibers increased considerably when L'' was in the neighborhood of 1/5Z. Accordingly, when L'' is at least about $\frac{1}{3}$Z the occurrence of neps in the spun yarn is substantially negligible, but when is less than about $\frac{1}{3}$L, the speed of occurrence of neps becomes high. In this example, the height of the flat surface 20 of the fiber diffusing section 4 used was 4 mm, and the diameter of a suction pipe thereof was 3 mm.

EXAMPLE 7

A silver consisting of 65% polyester and 35% cotton was roller-drafted to manufacture a 45'S fasciated-spun yarn using the same apparatus as in Example 6.

In this Example, the width Z of the fleece fed from the nip rollers was 25 mm, and the length L'' of the inlet surface 20 of the fiber diffusing section was 20 mm.

Spinning conditions:
Spinning speed: 145 m/mm
Draft ratio: 200
Pneumatic vacuum: 700 mmAq p1 Air pressure at nozzle: 3.0 kg/cm$^2$ The average strength of the yarn obtained was 202 g, and the strength was CV 11.2%. The yarn had substantially no neps, and was of high quality.

On the other hand, yarn spun by a fiber diffusing section having an inlet surface 20 length L'' of 5 mm had an average strength of 195 g, and the strength CV of the yarn was 15.1%. The yarn had many neps and was of unsatisfactory quality.

EXAMPLE 8

A polyester/cotton mixed staple yarn 45'S was spun by using a fasciated-spinning apparatus as shown in FIG. 1A, provided with a fiber-diffusing section shown in FIG. 9(1)A.

Dimensions of the fiber-diffusing section:
Total length U: 20 mm
Width of slit W: 0.6 mm
Length of slit L: 10 mm
Diameter of enlarged slit portion 25 W': 2.5 mm
Diameter of inlet portion 10 and outlet portion 12: 2.5×3 mm (cross-sectionally elliptic)
Angle of setting: $\theta=90°$
Spinning conditions:
Total drafting ratio: 200
Width of condenser between middle and rear portions of yarn passage: 4 mm
Suction vacuum: 700 mmAq
Air pressure at the false twist nozzle: 3.0 kg/cm$^2$
Spinning speed: 150 m/min The yarn spun under the above conditions had a strength of 213 g and an Uster yarn irregularity of 12.9%, and was of high quality. The yarn was produced at a high speed. The yarn was as soft as ring-spun yarn.

EXAMPLE 9

A polyester/cotton mixed staple yarn of 45'S was manufactured by a fasciated-spinning apparatus, the construction of which is shown in FIGS. 12 and 13. Dimensions of the fiber-diffusing section:

Total length U: 20 mm
Width of slit 24 W: 0.6 mm
Length of slit L: 10 mm
Diameter of enlarged slit portion 25 W': 2.5 mm
Angle between the common tangent of the nip point and the axis of the yarn: 30°
Angle between the enlarged slit portion 25 and the axis of the yarn: 30°
Spinning conditions:
Suction vacuum: 700 mmAq
Air pressure at the false-twist nozzle: 3.0 kg/cm$^2$
Spinning speed: 150 m/min The yarn spun under the above conditions had satisfactory characteristics. It had a strength of 200 g and an Uster yarn irregularity of 13.0%. The yarn was readily produced at a high speed.

EXAMPLE 10

A polyester/cotton mixed staple yarn of 45'S was spun by a fasciated-spinning apparatus, the construction of which is shown in FIG. 14. Dimensions of the fiber-diffusing section:

Total length of fiber diffusing section U: 20 mm
Width of the inlet portion L: 10 mm
Diameter of enlarged passageway 25 W': 2.5 mm
Width of space in slit 24' W: 0.6 mm
Spinning speed: 140 m/min
Suction vacuum: 700 mmAq
Air pressure at the false-twist nozzle: 3.0 kg/cm$^2$ The yarn spun under the above conditions had a strength of 180.7 g and a strength CV of 13.5%, with no practical problems with respect to the quality thereof.

It will accordingly be appreciated that in accordance with the principles of this invention a plurality of generally parallel fibers arranged in a longitudinal direction in the form of a sliver, band or the like (to which we have herein referred to generically as a "fleece") is moved along a predetermined path. Some of the fibers are located in the body portion of the fleece and others of the fibers are located near and along the edges of the fleece. It is further appreciated that, regardless of which of the many embodiments of the invention is utilized, a means is provided for forming differential fluid flow paths having an influence upon the fibers, one flowing faster than the other and having an influence upon the fibers located at or in the neighborhood of the edge of the fleece to wholly or partially separate a plurality of such edge fibers to cause them to by-pass the false-twisting operation to some degree or even entirely. In accordance with the principle of the invention, the differential fluid flow paths allow the body portion of the fleece to be caught up in the false-twister to form a false-twisted yarn composed primarily of the fibers of the body portion of the fleece, while fibers along at least one edge portion pass through the false-twisting operation with one or both ends free. Further in accordance with this invention the wholly or partially freed fibers are thereafter conducted in contact with the false-twisted yarn and become helically wrapped around such yarn during the detwisting step which is inherent in the false-twisting process resulting in a substantially detwisted core having a multiplicity of wrapper yarns helically wrapped around it.

Although the specification and drawings refer to a wide variety of procedures and apparatus for accomplishing the foregoing, it will be appreciated that many other variations may be made without departing from the spirit and scope of this invention. Although some of the devices shown in the drawings provide two flow paths of relatively higher speed symmetrically arranged with respect to one flow path of relatively lower speed, these paths need not be completely symmetrical (FIG. 2C(4)) and the paths may be arranged in a wide variety of geometric configurations (FIG. 2F). Further, it is not necessary to provide two or more flow paths having the relatively higher speed since in many cases a single higher speed flow path, in combination with a lower speed flow path, produces excellent results (FIGS. 3A, 3B, 3C). It will further be appreciated that differential fluid flow paths, one flowing faster or in a different direction than the other, may be provided in a variety of other ways provided the flowing fluid is diffused in a manner to wholly or partially separate a plurality of individual fibers with respect to the bundle of fibers being false-twisted. In this connection, it is highly desirable that the incoming fibers be spread out in a separable condition, substantially free of entanglement, thus facilitating the differentiation effect of the differential fluid flow paths. In this connection, drafting produces the fibers in a spread condition in which the fibers are readily separable; high draft ratios are extremely beneficial and it is preferable to utilize a fleece draft ratio of at least about 80, preferably of at least about 100-250 for that reason.

In connection with the separating effect of the differential fluid flow paths it will be appreciated, of course, that the relatively high speed flow path is preferably arranged at a direction different than the direction of movement of the fibers which are being false-twisted into yarn. As the drawings illustrate, wide varieties of specific geometric configurations are available for this purpose and the direction differences may be upwardly, downwardly or sidewardly arranged, or arranged in a variety of configurations to suit the specific conditions of a particular case.

According to the present invention, it will accordingly be realized that, a suction air current having a fiber-diffusing effect is utilized as a means for arranging and transferring the free fibers instead of a conveyor belt, pneumatic false-twisting nozzle, or aspirator, which are used in other devices. Therefore, the apparatus according to the present invention when used in the manufacture of spun yarn provides valuable improvement in high-speed stability and quality of the yarn and prolongs the life of the apparatus. The present invention also permits a simplification of the construction of the apparatus, minimizing equipment cost and greatly reducing maintenance expense.

We claim:

1. A fasciated yarn spinning apparatus having a drafting section, a false-twisting section and a delivery section, characterized in that said false-twisting section is adapted to produce a false-twisted core and a plurality of outside fibers, said apparatus including a fiber-diffusing section using a suction fluid between the final nip point in said drafting section and said false-twisting section, said fiber-diffusing section being arranged to control the path of movement of outside fibers to cause the outside fibers to return in a uniform manner alongside the false-twisted core.

2. A fasciated yarn-spinning apparatus having means for arranging a multiplicity of fibers generally lengthwise along a predetermined path in a spread condition to form a fiber group wherein the fibers are readily separable from one another, means for feeding said fiber group along said path, a false-twist means in said path and arranged to apply false twist to a portion of the fibers of said group, and fiber-diffusing means positioned downstream of said feed means including differential fluid flow passageway means for separating some of the fibers from said fiber group and conducting them separately to said false twist means.

3. Apparatus according to claim 2, wherein said fiber-diffusing means is provided with passageway means arranged to receive and convey the fiber group, said diffusing means having differential cross-sectional areas in said passageway, and a fluid flow means being connected to move fluid through said differential areas as different currents, thereby separating a portion of the fibers from the fiber group.

4. Apparatus according to claim 3, wherein said passageway means of said fiber-diffusing means has a varying width so as to provide connected passageways having different fluid flow characteristics in said fiber-diffusing section.

5. Apparatus according to claim 4, wherein said fiber-diffusing section comprises a fiber passageway the size of which varies across the width of the fiber group carried in said passageway.

6. Apparatus according to claim 5, wherein said fiber-diffusing section has at least one enlarged fiber-carrying passageway provided at at least one portion of said passageway, the size of said passageway being greater than the size of other portions of said passageway.

7. Apparatus according to claim 2, wherein said fiber passageway of said fiber-diffusing section has a cross-sectional shape or cross-sectional area which varies along the path of advancement of said fibers in said fiber-diffusing section.

8. Apparatus according to claim 3, wherein said fiber-diffusing section is tilted relative to the path of advancement of said fibers.

9. Apparatus according to claim 2, wherein the distance between said feed means and the inlet of said fiber-diffusing section is about 5–20 mm, and wherein the distance between said feed means and said false-twist means is not more than twice the average length of the short fibers in said fiber group.

10. Apparatus according to claim 2, wherein said fiber-diffusing means includes a surface at the inlet of said fiber-diffusing means which faces said feed means, and wherein said surface is substantially flat.

11. Apparatus according to claim 2, wherein the fiber group is fed toward said fiber-diffusing means in a predetermined direction, and wherein at least one of said differential fluid flow passageways is arranged at an angle to said predetermined direction.

12. The apparatus according to claim 11, wherein said angle is about 10°–90°.

13. In an apparatus for making a fasciated yarn wherein means are provided for feeding along a predetermined path a fleece which comprises a plurality of fibers to a false-twister to form the fleece into a false-twisted yarn, and wherein said false-twister includes means for subsequently detwisting the fibers of the false-twisted fleece to produce the fasciated-spun yarn product, the combination which comprises:

(a) a fiber diffusing means positioned downstream of said feeding means and upstream of said false-twisting means including fluid means for separating individual fibers from the fleece and maintaining them separate while other fibers of the fleece are false-twisted, and (b) conduit means extending downstream of said false-twister for uniting the separated individual fibers with the false-twisted fleece downstream of said false-twister for subsequent wrapping of said individual fibers around said false-twisted fleece when said false-twisted fleece is detwisted.

14. In an apparatus including false-twist means for producing fasciated yarn and a feed means for feeding a multiplicity of individual fibers arranged lengthwise to form a band having opposed edges, some of the individual fibers being located in the body of the band and others of the individual fibers being located along said edges, fiber control means located intermediate said feed means and said false-twist means, said fiber control means including fiber-carrying passageway means and fluid flow means coating with said passageway means and band to divert from their path a plurality of those individual fibers which are located along said edges of said band while moving toward and to said false-twister the individual fibers located in the body of the band, said fiber control means including conduit means for maintaining the diverted edge fibers separate from the body fibers as they are false-twisted, and means for reuniting said diverted edge fibers with said false-twisted fibers and for detwisting said false twisted fibers in contact with said diverted edge fibers.

15. The apparatus defined in claim 13, wherein said feed means is a fiber drafting section, and wherein said fibers are drafted at a ratio of at least about 80.

16. The apparatus defined in claim 15, wherein said ratio is about 100 to 250.

17. The apparatus defined in claim 14, wherein said fiber control means comprises means forming a chamber having communicating passageways of different areas, and wherein means are provided for drawing air through said chambers in streams at differential velocities in said different areas, one such velocity being higher than another velocity, whereby fibers are separated from the body of the band by action of the higher velocity stream of air.

18. The apparatus defined in claim 17, wherein said passageways include a slit and at least one enlarged slit portion.

19. The apparatus defined in claim 18, wherein said slit and said enlarged slit portion are substantially parallel in the direction of movement of the band.

20. The apparatus defined in claim 18, wherein said slit and said enlarged slit portion are arranged at angles to each other.

21. The apparatus defined in claim 17, wherein a single slit and a single enlarged slit portion are provided in said fiber control means.

22. The apparatus defined in claim 18, wherein said enlarged slit portion is arranged off-center relative to the band path.

23. The apparatus defined in claim 14, wherein the fiber control means has an entrance opening which is arranged at an angle to the band path, and wherein said fluid flow means is connected to draw air in through said entrance at an angle at least partially crosswise relative to the band path to thereby separate some of the fibers from the band.

24. The apparatus defined in claim 14, wherein the fiber control means includes a chamber arranged at an angle to the band path, whereby the band is caused to change direction in said fiber-carrying passageways, in the presence of said fluid flow.

* * * * *